US009072372B2

(12) United States Patent
Ashley

(10) Patent No.: US 9,072,372 B2
(45) Date of Patent: Jul. 7, 2015

(54) HANGING TRAY DEVICE

(71) Applicant: Eugene B. Ashley, Scottsdale, AZ (US)

(72) Inventor: Eugene B. Ashley, Scottsdale, AZ (US)

( * ) Notice: Subject to any disclaimer, the term of this patent is extended or adjusted under 35 U.S.C. 154(b) by 0 days.

(21) Appl. No.: 14/325,333

(22) Filed: Jul. 7, 2014

(65) Prior Publication Data

US 2015/0021284 A1 Jan. 22, 2015

Related U.S. Application Data

(60) Provisional application No. 61/843,775, filed on Jul. 8, 2013.

(51) Int. Cl.

| | |
|---|---|
| ***A47F 5/08*** | (2006.01) |
| ***A47B 23/04*** | (2006.01) |
| ***A47G 23/06*** | (2006.01) |
| ***A47B 25/00*** | (2006.01) |
| ***F16B 12/00*** | (2006.01) |
| ***A63F 1/06*** | (2006.01) |

(52) U.S. Cl.

CPC ..... *A47B 23/04* (2013.01); *A47G 23/06* (2013.01); *A47B 25/00* (2013.01); *F16B 12/00* (2013.01); *A63F 1/067* (2013.01); *A47B 2200/0085* (2013.01)

(58) Field of Classification Search

CPC ..... A47B 25/00; A47B 23/04; A47B 2200/0085; A47G 23/06; F16B 12/00; A63F 1/067

USPC ..... 108/26, 42, 47, 134, 135, 157.1, 108/157.13, 157.14, 152; 211/118, 126.6, 211/130.1, 132.1; 248/346.3, 309.1, 310, 248/311.2; 206/806; 297/188.06, 188.18; 294/144; 224/560, 564, 926, 276

See application file for complete search history.

(56) References Cited

U.S. PATENT DOCUMENTS

| | | | | | |
|---|---|---|---|---|---|
| 117,737 | A | * | 8/1871 | Byram | 108/26 |
| 573,960 | A | * | 12/1896 | Bruss | 108/26 |
| 581,127 | A | * | 4/1897 | McCorkle | 108/26 |
| 1,267,046 | A | * | 5/1918 | Beaird | 108/135 |
| 1,925,523 | A | * | 9/1933 | Cuff et al. | 224/482 |
| 2,173,569 | A | * | 9/1939 | Troendle | 297/146 |
| 2,508,802 | A | * | 5/1950 | Schade | 108/28 |
| 2,556,724 | A | * | 6/1951 | Hubseh | 297/173 |
| 2,687,336 | A | * | 8/1954 | Smith et al. | 297/163 |
| 2,720,436 | A | * | 10/1955 | Covey | 297/163 |
| 2,825,611 | A | * | 3/1958 | Aynesworth | 108/45 |
| 2,836,261 | A | * | 5/1958 | Neilson | 108/42 |
| 2,932,544 | A | * | 4/1960 | Lambert | 297/163 |
| 3,013,514 | A | * | 12/1961 | Stanton | 112/260 |
| 3,232,250 | A | * | 2/1966 | Hamilton et al. | 108/44 |
| 3,233,563 | A | * | 2/1966 | Mauchline | 108/44 |
| 3,386,392 | A | * | 6/1968 | Gramm | 108/44 |

(Continued)

*Primary Examiner* — Joshua J Michener
*Assistant Examiner* — Devin Barnett
(74) *Attorney, Agent, or Firm* — Robert A. Parsons; Michael W. Goltry; Parsons & Goltry

(57) ABSTRACT

A hanging tray for use on a gaming table having a raised rail, a table top and a junction between the rail and the table top is described. The hanging tray includes a main tray, a vertical support section hingedly coupled to the main tray section and movable between a collapsed position and a deployed position. A rail section is hingedly coupled to the vertical support section and is movable between a collapsed position and a deployed position. An engagement member extends from the end of the rail section for engagement with the junction, anchoring the rail section over the rail.

15 Claims, 6 Drawing Sheets

(56) References Cited

U.S. PATENT DOCUMENTS

| | | | | | |
|---|---|---|---|---|---|
| 3,391,891 | A | * | 7/1968 | Garden | 248/311.2 |
| 4,557,452 | A | * | 12/1985 | Khuong | 248/214 |
| 4,560,128 | A | * | 12/1985 | Willeby et al. | 248/230.4 |
| 4,575,149 | A | * | 3/1986 | Forestal et al. | 297/145 |
| 4,953,771 | A | * | 9/1990 | Fischer et al. | 224/549 |
| D313,963 | S | * | 1/1991 | Gunnarsson et al. | D12/419 |
| 4,981,277 | A | * | 1/1991 | Elwell | 248/311.2 |
| 4,984,722 | A | * | 1/1991 | Moore | 224/549 |
| 5,072,909 | A | * | 12/1991 | Huang | 248/311.2 |
| 5,087,008 | A | * | 2/1992 | Miller et al. | 248/311.2 |
| D329,358 | S | * | 9/1992 | Espinosa, Jr. | D7/620 |
| 5,195,711 | A | * | 3/1993 | Miller et al. | 248/311.2 |
| 5,294,026 | A | * | 3/1994 | McGirt | 224/549 |
| 5,511,493 | A | * | 4/1996 | Kanehl, Jr. | 108/44 |
| 5,524,958 | A | * | 6/1996 | Wieczorek et al. | 297/188.17 |
| 5,588,697 | A | * | 12/1996 | Yoshida et al. | 297/173 |
| 5,673,891 | A | * | 10/1997 | Fujihara et al. | 248/311.2 |
| 5,692,658 | A | * | 12/1997 | Fischer et al. | 224/281 |
| 5,692,718 | A | * | 12/1997 | Bieck | 248/311.2 |
| 5,722,329 | A | * | 3/1998 | Weng | 108/47 |
| 5,890,692 | A | * | 4/1999 | Lee et al. | 248/311.2 |
| 5,996,507 | A | * | 12/1999 | Joseph | 108/46 |
| 6,024,395 | A | * | 2/2000 | Kang | 296/37.8 |
| 6,095,471 | A | * | 8/2000 | Huang | 248/311.2 |
| 6,105,917 | A | * | 8/2000 | Yabuya et al. | 248/311.2 |
| D431,423 | S | * | 10/2000 | Ohm et al. | D7/620 |
| 6,250,527 | B1 | * | 6/2001 | Mizue et al. | 224/281 |
| 6,409,061 | B1 | * | 6/2002 | Fischer et al. | 224/281 |
| 6,427,960 | B1 | * | 8/2002 | Gehring et al. | 248/311.2 |
| 6,464,187 | B1 | * | 10/2002 | Bieck et al. | 248/311.2 |
| D473,840 | S | * | 4/2003 | Sauer | D12/416 |
| 6,685,152 | B2 | * | 2/2004 | Shirase et al. | 248/311.2 |
| 6,779,769 | B1 | * | 8/2004 | York et al. | 248/311.2 |
| D559,043 | S | * | 1/2008 | Peota et al. | D7/620 |
| 7,341,005 | B2 | * | 3/2008 | Baggott | 108/42 |
| D593,930 | S | * | 6/2009 | Fossett | D12/420 |
| 7,739,964 | B2 | * | 6/2010 | Hatton | 108/47 |
| 8,079,553 | B1 | * | 12/2011 | Martin | 248/145 |
| 8,245,650 | B1 | * | 8/2012 | McKsymick | 108/25 |
| 8,636,319 | B1 | * | 1/2014 | Parker, Jr. | 297/188.12 |
| 2002/0073899 | A1 | * | 6/2002 | Chen | 108/44 |
| 2003/0019993 | A1 | * | 1/2003 | Yamada | 248/311.2 |
| 2003/0066462 | A1 | * | 4/2003 | Getfield | 108/44 |
| 2004/0021050 | A1 | * | 2/2004 | Izume | 248/311.2 |
| 2005/0194506 | A1 | * | 9/2005 | Lang et al. | 248/311.2 |
| 2006/0038101 | A1 | * | 2/2006 | Oana | 248/311.2 |
| 2006/0060741 | A1 | * | 3/2006 | Yanagita et al. | 248/311.2 |
| 2006/0065802 | A1 | * | 3/2006 | Harada | 248/311.2 |
| 2006/0237499 | A1 | * | 10/2006 | Teichrieb | 224/281 |
| 2009/0224124 | A1 | * | 9/2009 | Kniazyszcze et al. | 248/311.2 |
| 2009/0283432 | A1 | * | 11/2009 | Bean | 206/445 |
| 2010/0109381 | A1 | * | 5/2010 | Plavetich | 296/193.01 |
| 2011/0181007 | A1 | * | 7/2011 | Caruso et al. | 280/33.992 |
| 2011/0278196 | A1 | * | 11/2011 | Hamilton | 206/557 |
| 2012/0032479 | A1 | * | 2/2012 | Suhre | 297/188.01 |
| 2012/0056063 | A1 | * | 3/2012 | Shimajiri | 248/311.2 |
| 2012/0227637 | A1 | * | 9/2012 | Meadows et al. | 108/28 |

* cited by examiner

HANGING TRAY DEVICE

FIELD OF THE INVENTION

This invention relates to tray devices.

More particularly, the present invention relates to collapsible hanging tray devices.

BACKGROUND OF THE INVENTION

Some forms of table gaming, such as poker, other card games, mahjongg, and the like, can occur over a long period of time. During this period of time, an individual occupied with the game may have various needs or desires. Included in these, is the need or desire for beverages, snacks, gaming paraphernalia, electronic devices and the like. Many gaming rules include preventing placing such items on the table during play. Thus, these items must be brought to the table periodically for use, set on the floor, or avoided altogether. Balancing items on the rail of gaming tables can cause accidental spills and gaming delays. Alternatively, if allowed on the table, they can cause clutter, or result in accidental spills and the like. Some tables include cup holders on the rail. While somewhat effective, beverages placed on a rail cup holder can also be spilled onto the table surface, delaying gaming, disrupting gaming, and requiring time consuming cleaning.

It would be highly advantageous, therefore, to remedy the foregoing and other deficiencies inherent in the prior art.

An object of the present invention is to provide a hanging tray for use on a gaming table.

Another object of the present invention is to provide a hanging tray for supporting items outside and below the rail.

Another object of the present invention is to provide a rail sleeve for supporting a structure outside the rail.

Yet another object of the present invention is to provide a rail sleeve having an indicia device.

SUMMARY OF THE INVENTION

Briefly, to achieve the desired objects and advantages of the instant invention, provided is a hanging tray for use on a gaming table having a raised rail, a table top and a junction between the rail and the table top. The hanging tray includes a main tray section having a tray surface, opposing sides, a back side and a front. A vertical support section includes a top edge and a bottom edge hingedly coupled to the back side of the main tray section by a first hinge structure. The vertical support section is movable between a collapsed position, overlying the tray surface and bounded by the opposing sides and the front, and a deployed position, wherein the vertical support section is positioned at an angle substantially perpendicular to the main tray section. Also provided is a rail section for overlying the rail. The rail section has an end and an opposing end. The end of the rail section is hingedly coupled to the top edge of the vertical support section by a second hinge structure and movable between a collapsed position, overlying the vertical support section and bounded by the opposing sides and the front, and a deployed position wherein the rail section is positioned at an angle substantially perpendicular to the vertical support section and generally parallel to the main tray section. An engagement member extends from the end of the rail section for engagement with the junction, anchoring the rail section over the rail.

Also provided is a rail sleeve for use on a gaming table having a raised rail, a table top and a junction between the rail and the table top. The rail sleeve includes a rail section for overlying the rail and having an end and an opposing end. An engagement member extends from the end of the rail section for engagement with the junction, anchoring the rail section over the rail. A depending member extends from the opposing end of the rail section on the outside of the rail. An indicia display is carried by the rail section.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
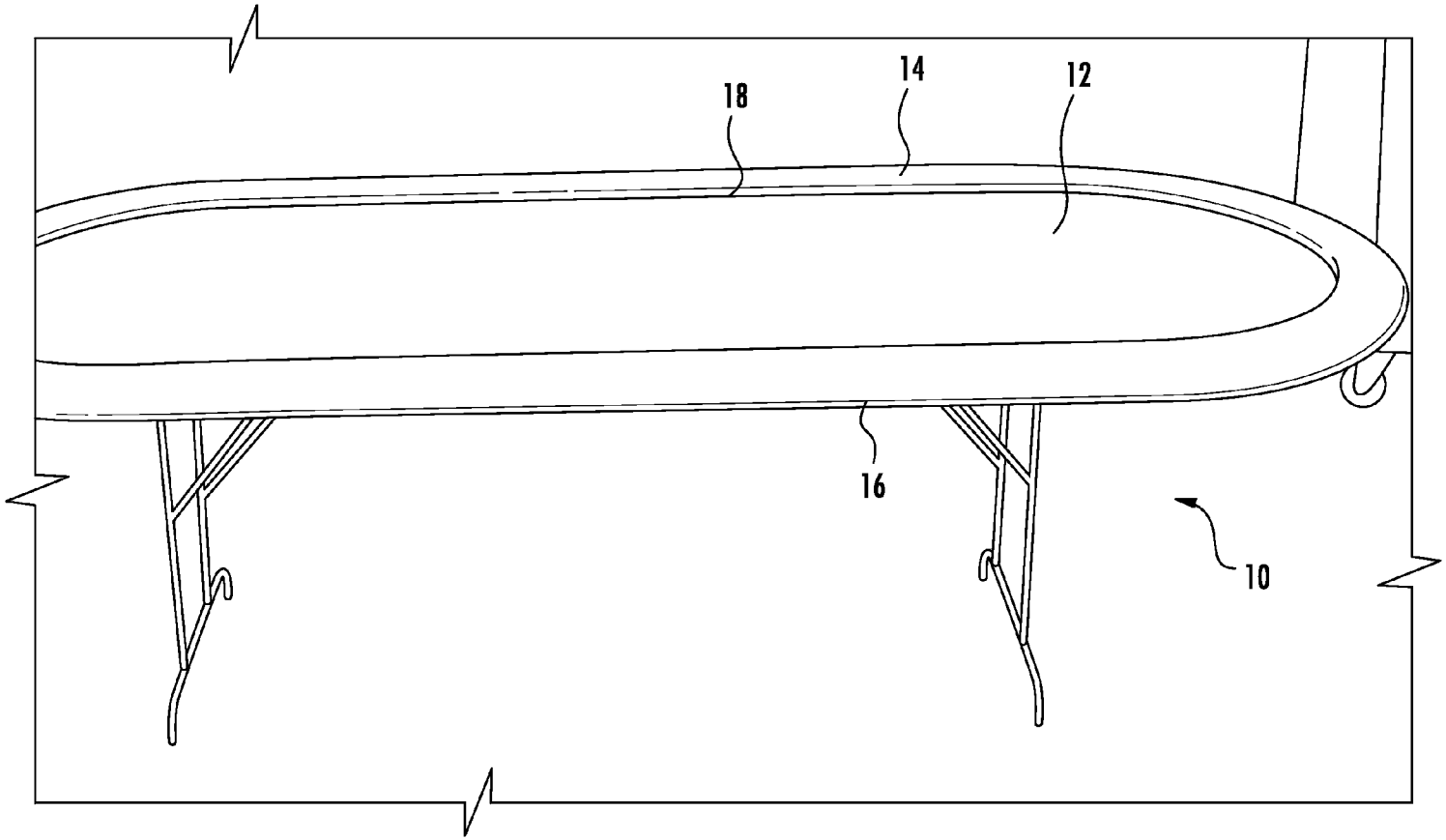
FIG. 1 is a perspective view of a table having a peripheral rail.

Turning now to the drawings in which like reference characters indicate corresponding elements throughout the several views, attention is directed to FIG. 1 which illustrates a table generally designated 10. Table 10, preferred for use with the present invention, includes a table top 12 having a rail 14 carried by a peripheral edge 16. Table 10 can be substantially any size or shape, and is typically used for card games such as poker and the like, although other games can be played such as dominoes, etc. While substantially any table may be utilized, table 10 must have a juncture 18 between table top 12 and rail or rail like structure 14.

Figure 2:
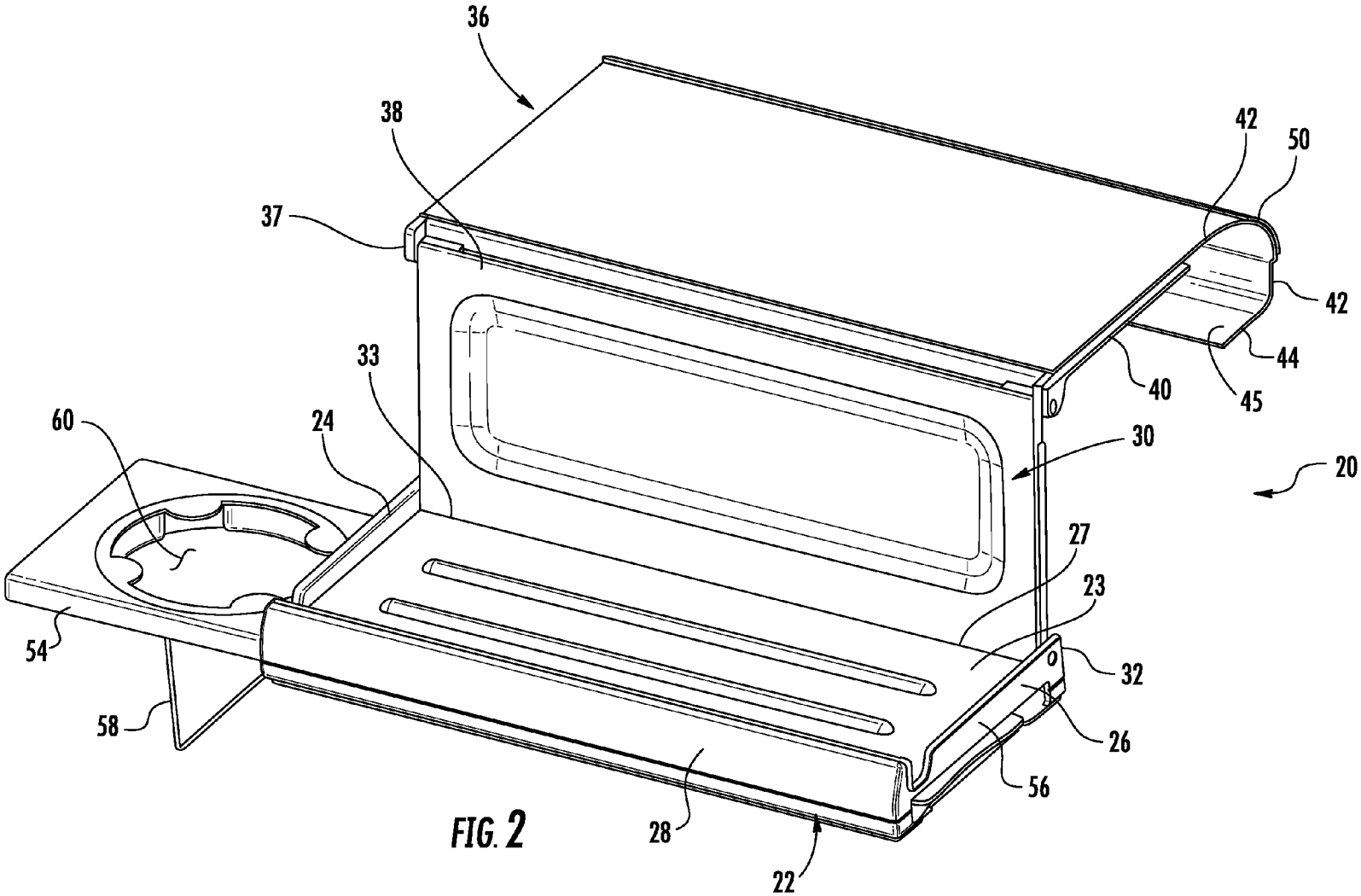
FIG. 2 is a perspective front view of a tray device according to the present invention, as it would appear in an open configuration.
Figure 3:
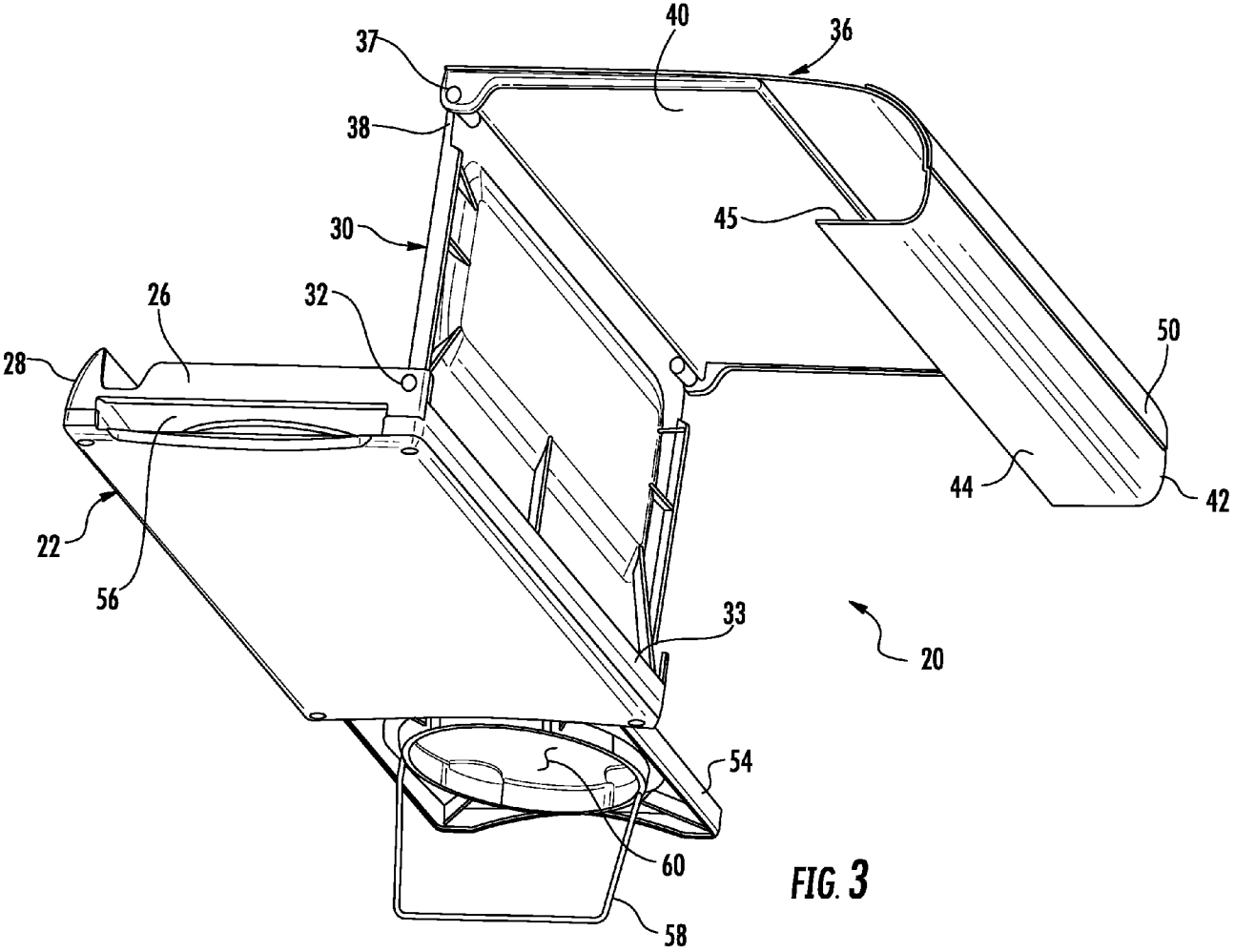
FIG. 3 is a perspective rear view of the tray device of FIG. 2, as it would appear in an open configuration.
Figure 4:
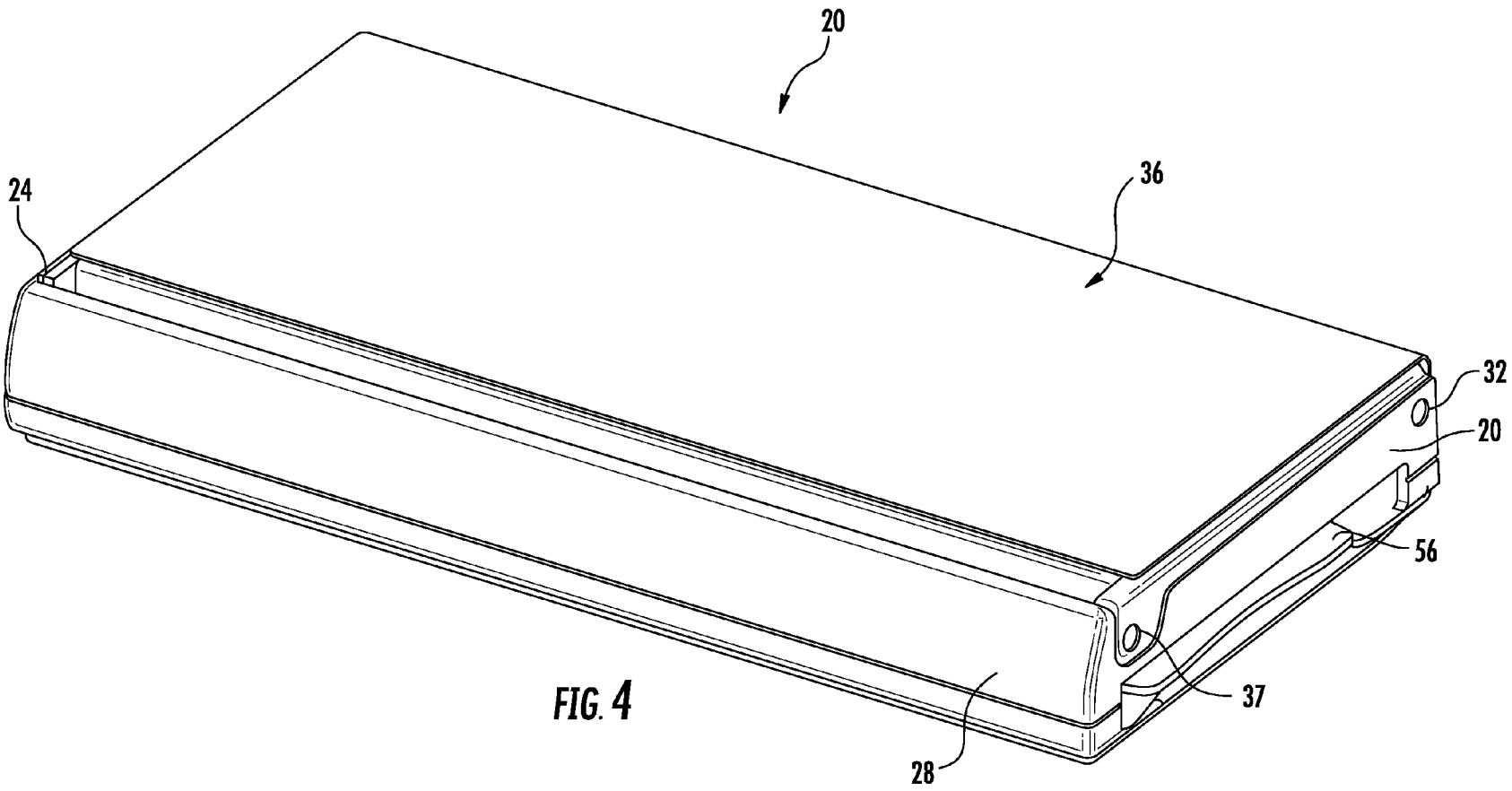
FIG. 4 is a perspective front view of the tray device of FIG. 2, as it would appear in a closed configuration.

Turning now to FIGS. 2, 3 and 4, a hanging tray device generally designated 20, is illustrated in an open configuration. Hanging tray 20 includes a main tray section 22 having a tray surface 23, opposing sides 24 and 26, a back side 27 and a front 28. While main tray section 22 is a generally planar element in the preferred embodiment, it will be understood by one of ordinary skill in the art that main tray 22 can be substantially any structure used to support other items. Also, while main tray 22 is illustrated as generally rectangular, it will be understood that other shapes such as square, round, oval and the like can be employed. A vertical support section 30 is hingedly coupled to back side 27 of main tray section 22, by a hinge structure 32 at a lower edge 33. Vertical support section 30 is movable between a collapsed position, overlying tray surface 23 and bounded by opposing sides 24 and 26, and front 28, and a deployed position wherein vertical support section 30 is positioned at an angle substantially perpendicular to main tray section 22. A rail section 36 is hingedly coupled to a top edge 38 of vertical support section 30, by a hinge structure 37. Rail section 36 is movable between a collapsed position, overlying vertical support section 30 and bounded by opposing sides 24 and 26, and front 28, and a deployed position wherein rail section 36 is positioned at an angle substantially perpendicular to vertical support section 30 and generally parallel to main tray section 22. Rail section 36 preferably includes a rigid portion 40 and a flexible offset portion 42. Rigid portion 40 is sized to extend substantially from front 28 to back side 27 in the closed position overlying vertical support section 30. Rigid portion 40 is preferably approximately the length of the width of a rail 14 which it overlies when installed in the deployed position. Flexible offset portion 42 extends from rigid portion 40 and terminates in an engagement member 44. Engagement member 44 includes a rigid insert 45 attached thereto to facilitate insertion into juncture 18 between table top 12 and rail or rail like structure 14. Rigid insert 45 can also include magnets to facilitate closure of the device as will be described presently. Rail section 36 can be made adjustable, such as by telescoping elements or the like, to accommodate differing widths and heights of rail 14.

Figure 5:
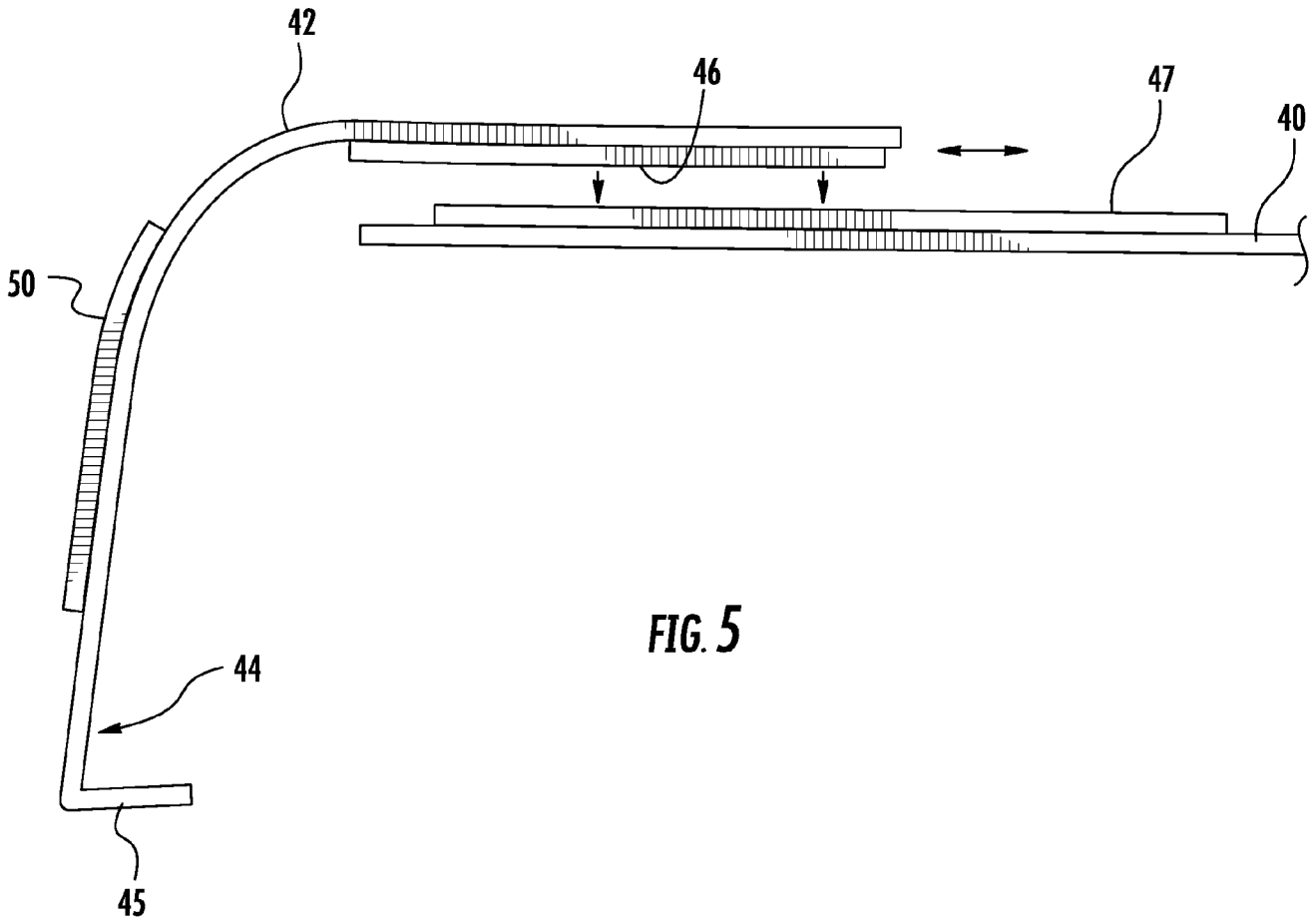
FIG. 5 is a partial sectional side view of a rail sleeve according to the present invention.

With momentary reference to FIG. 5, an efficient method of providing adjustability is to provide flexible offset portion 42 with a releasable fastener to facilitate adjustably attaching flexible offset portion 42 to rigid portion 40. An example of a releasable fastener is Velcro®. One element 46 of Velcro® is attached to the bottom of flexible offset portion 42 and the complimental element 47 is attached to the top of rigid portion 40.

Figure 6:
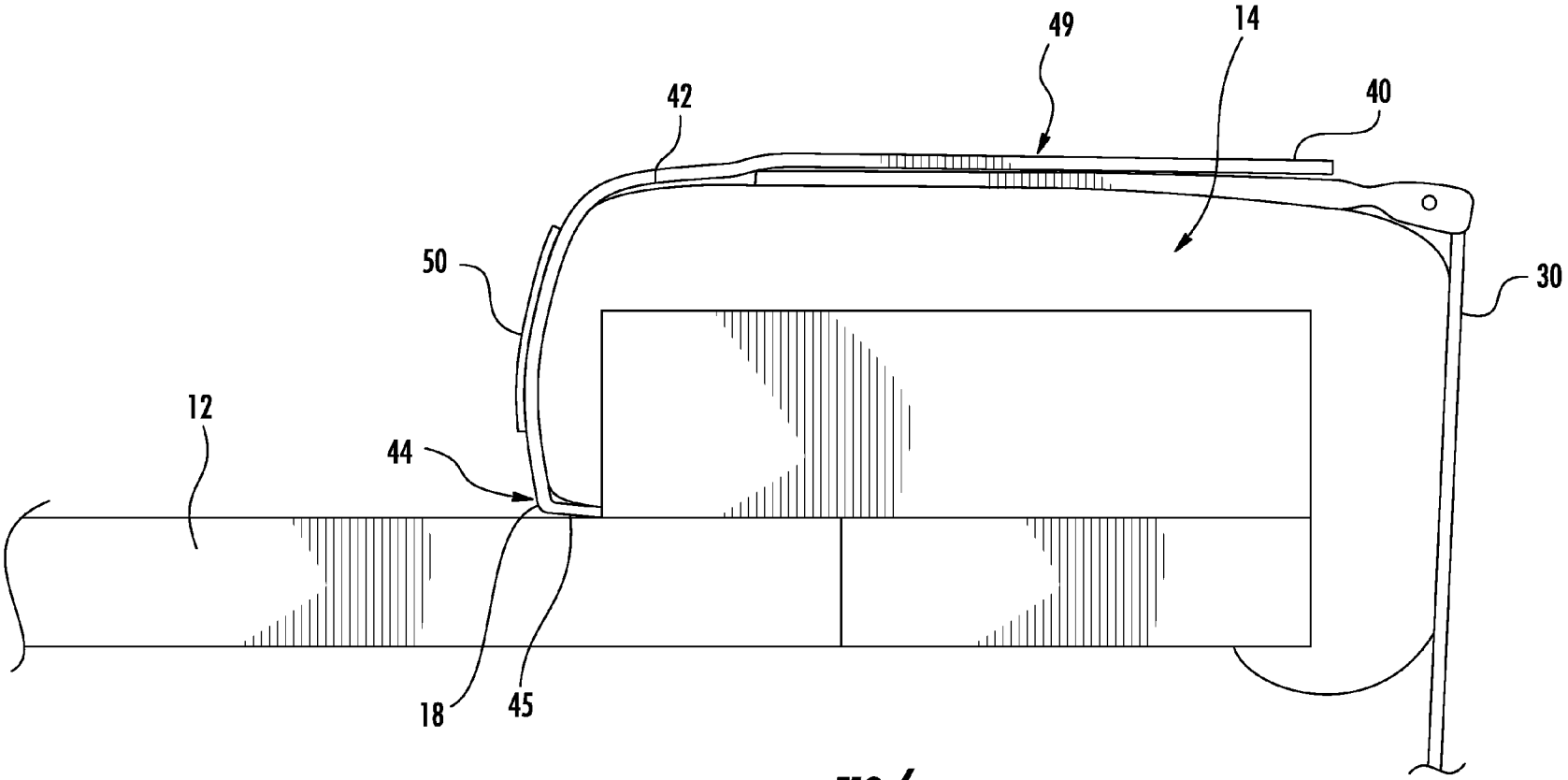
FIG. 6 is a partial sectional side view of the rail sleeve attached to a gaming table.

With brief reference to FIG. 6, tray device 20 is mounted to table 10 with a rail sleeve 49. Rail sleeve 49 includes rail section 36 supporting a depending member, which in this preferred embodiment is vertical support section 30. As described previously, rail section 36 includes rigid portion 40 overlying rail 14 and flexible offset portion 42 adjustably coupled thereto and terminating in engagement member 44. Engagement member 44 anchors flexible offset portion 42 over rail 14. In the preferred embodiment this is accomplished by inserting rigid insert 45 into junction 18. Thus, rail sleeve 49 can be used to support a structure outside rail 14, such as main tray section 22, and provide an indicia display 50, as will be described presently.

Indicia display 50 can be carried by flexible offset portion 42, to prominently display various indicia as desired. Indicia display 50 can include a band encircling flexible offset portion 42 to permit adjusting movement thereof. Alternatively, indicia display 50 can be removable attached to flexible offset portion 42 using fasteners such as snaps, clips, Velcro, and the like. Additionally, the surface of flexible offset portion 50 can simply be printed upon or otherwise used to display indicia. When hanging tray device 20 is used in a gaming environment, or anywhere else, offset section 42 can be adjusted to display indicia display 50 across table 10 so as to be visible to the other players and bystanders. This provides a surface which can be employed with the users name or identity and/or advertising space as desired. Thus, hanging tray 20 can be used for advertising purposes, marketing, or simply personalized to the individual using the hanging tray or organization supporting the gaming.

Still referring to FIGS. 2, 3 and 4, hanging tray 20 further includes main tray section 22 having a peripheral section 54 extendable from side 24, and a peripheral section 56 extendable from side 26. Peripheral sections 54 and 56 each are movable between an extended position, extending from sides 24 and 26 of main tray section 22, respectively, and a retracted position received through sides 24, and 26, respectively, and underlying tray surface 23. Peripheral sections 54 and 56 each form a cup holder in the extended position. A wire support 58 is carried by each peripheral section 54 and 56, and is hingedly movable between a lowered position below a cup receiving opening 60 formed in each peripheral section 54 and 56, (FIG. 2) and a raised position when stored.

Hanging tray device 20 is positioned on table 10 in a deployed configuration so as to hang down from rail 15 outside table 10 to provide a convenient surface upon which to carry items. Peripheral sections 54 and 56 and main tray section 22 are maintained in a generally level horizontal plane forming a tray for supporting beverages, dishes, electronic devices and the like below the level of rail 14. Main tray section 22 is held generally perpendicularly with respect to vertical support section 30, which hangs downwardly from rail 14 of table 10. Vertical support section 30 is held in position by rail section 36 oriented substantially perpendicularly to vertical support section 30, and overlying rail 14. This is accomplished by limiting the range of movement of hinge structures 32 and 37 to approximately 90 degrees.

Hanging tray 20, as shown in FIG. 4 in the closed configuration, includes main tray section 22 with vertical support section 30 in the collapsed position, overlying tray surface 23 and bounded by opposing sides 24 and 26, and front 28. Rail section 36 is in a collapsed position, overlying vertical support section 30 and bounded by opposing sides 24 and 26, and front 28. Rigid portion 40 of rail section 36 overlies vertical support section 30. Flexible offset portion 42 wraps under main tray section 22 where rigid insert 45 can latch the device closed such as with a magnet.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A hanging tray for use on a gaming table having a table top, a raised rail extending upwardly from the table top, and a junction edge between the rail and the table top, the hanging tray comprising:

a main tray section having a tray surface, opposing sides, a back side and a front;

a vertical support section having a top edge and a bottom edge, the bottom edge hingedly coupled to the back side of the main tray section by a first hinge structure, the vertical support section movable between a collapsed position, overlying the tray surface and bounded by the opposing sides and the front, and a deployed position, wherein the vertical support section is positioned at an angle substantially perpendicular to the main tray section;

a rail section for overlying the rail and having a first end and an opposing second end, the first end of the rail section hingedly coupled to the top edge of the vertical support section by a second hinge structure and movable between a collapsed position, overlying the vertical support section and bounded by the opposing sides and the front, and a deployed position wherein the rail section is positioned at an angle substantially perpendicular to the vertical support section and generally parallel to the main tray section; and an engagement member extending generally downwardly from the second end of the rail section for engagement with the junction edge, anchoring the rail section over the rail to suspend the hanging tray from the gaming table in the deployed position, wherein the engagement member is capable of latching the hanging tray in a closed position when the vertical support section and the rail section are in the collapsed position.

2. A hanging tray as claimed in claim 1 wherein the rail section further includes a rigid portion and a flexible offset portion adjustably coupled thereto.

3. A hanging tray as claimed in claim 2 wherein the flexible offset portion is adjustably coupled to the rigid portion with a releasable fastener including an element attached to a bottom of the flexible offset portion and a complimental element attached to a top of the rigid portion.

4. A hanging tray as claimed in claim 3 wherein the engagement member includes a rigid insert receivable by the junction.

5. A hanging tray as claimed in claim 2 wherein the rigid portion is sized to extend substantially from the front to the back side in the closed position, overlying the vertical support section.

6. A hanging tray as claimed in claim 1 further including a peripheral section extending from one of the opposing sides of the main tray section, the peripheral section movable between an extended position, extending from the one of the opposing sides, and a retracted position, received through the one of the opposing sides and underlying the tray surface.

7. A hanging tray as claimed in claim 1 wherein the peripheral section include a cup holder in the extended position.

8. A hanging tray as claimed in claim 6 further including a second peripheral section extending from an other one of the opposing sides of the main tray section, the peripheral section movable between an extended position, extending from the other one of the opposing sides, and a retracted position, received through the other one of the opposing sides and underlying the tray surface.

9. A hanging tray comprising:

a gaming table having a table top, a raised rail extending upwardly from the table top, and a junction edge between the rail and the table top;

a main tray section having a tray surface, opposing sides, a back side and a front;

a vertical support section having a top edge and a bottom edge, the bottom edge hingedly coupled to the back side of the main tray section by a first hinge structure, the vertical support section movable between a collapsed position, overlying the tray surface and bounded by the opposing sides and the front, and a deployed position, wherein the vertical support section is positioned at an angle substantially perpendicular to the main tray section;

a rail section overlying the rail and having a first end and an opposing second end, the first end of the rail section hingedly coupled to the top edge of the vertical support section by a second hinge structure and movable between a collapsed position, overlying the vertical support section and bounded by the opposing sides and the front, and a deployed position wherein the rail section is positioned at an angle substantially perpendicular to the vertical support section and generally parallel to the main tray section; and an engagement member extending generally downwardly from the second end of the rail section engaged with the junction edge, anchoring the rail section over the rail to suspend the hanging tray from the gaming table.

10. A hanging tray as claimed in claim 9 wherein the rail section further includes a rigid portion and a flexible offset portion adjustably coupled thereto.

11. A hanging tray as claimed in claim 10 wherein the flexible offset portion is adjustably coupled to the rigid portion with a releasable fastener including an element attached to a bottom of the flexible offset portion and a complimental element attached to a top of the rigid portion.

12. A hanging tray as claimed in claim 11 wherein the engagement member includes a rigid insert received by the junction.

13. A hanging tray as claimed in claim 10 wherein the rigid portion is sized to extend substantially from the front to the back side in the collapsed position, overlying the vertical support section.

14. A hanging tray as claimed in claim 9 further including a peripheral section extending from one of the opposing sides of the main tray section, the peripheral section movable between an extended position, extending from the one of the opposing sides, and a retracted position, received through the one of the opposing sides and underlying the tray surface.

15. A hanging tray as claimed in claim 14 further including a second peripheral section extending from an other one of the opposing sides of the main tray section, the peripheral section movable between an extended position, extending from the other one of the opposing sides, and a retracted position, received through the other one of the opposing sides and underlying the tray surface.

* * * * *